US006792666B1

(12) United States Patent
Bolotinsky et al.

(10) Patent No.: US 6,792,666 B1
(45) Date of Patent: Sep. 21, 2004

(54) THREE-PHASE TRANSFORMER

(75) Inventors: Yuri Bolotinsky, Netanya (IL); Alexander Rubshtein, Ashkelon (IL); Michael Savulkin, Netanya (IL)

(73) Assignee: A.T.T Advanced Transformer Technologies (1998) Ltd., Even Yehuda (IL)

( * ) Notice: Subject to any disclaimer, the term of this patent is extended or adjusted under 35 U.S.C. 154(b) by 0 days.

(21) Appl. No.: 09/830,468

(22) PCT Filed: Oct. 25, 1999

(86) PCT No.: PCT/IL99/00562

§ 371 (c)(1),
(2), (4) Date: Jun. 11, 2001

(87) PCT Pub. No.: WO00/25327

PCT Pub. Date: May 4, 2000

(30) Foreign Application Priority Data

Oct. 26, 1998 (IL) ..... 126748

(51) Int. Cl.[7] ..... H01F 7/06

(52) U.S. Cl. ..... 29/602.1; 336/60; 336/90; 336/94; 336/96

(58) Field of Search ..... 29/602.1; 336/60, 336/213, 90, 94, 96, 214, 215, 5, 10, 12, 183, 205, 223, 225

(56) References Cited

U.S. PATENT DOCUMENTS

| | | | | |
|---|---|---|---|---|
| 2,702,887 A | | 2/1955 | Joublanc | 336/5 |
| 2,909,742 A | | 10/1959 | Lamberton | 336/212 |
| 3,399,365 A | | 8/1968 | Vadim | |
| 3,684,991 A | | 8/1972 | Trump et al. | 336/70 |
| 4,338,657 A | * | 7/1982 | Lisin et al. | 363/68 |
| 4,413,406 A | | 11/1983 | Bennett et al. | |
| 4,639,705 A | | 1/1987 | Beisser | 336/5 |
| 4,893,400 A | | 1/1990 | Chenoweth | 29/606 |
| 5,168,255 A | * | 12/1992 | Poulsen | 336/5 |
| 5,398,402 A | | 3/1995 | Valencic et al. | 29/606 |
| 5,441,783 A | | 8/1995 | Silgailis et al. | 428/37 |

FOREIGN PATENT DOCUMENTS

| | | | |
|---|---|---|---|
| CH | 483707 | | 2/1970 |
| EP | 0 151 048 | * | 8/1985 |
| FR | 1 311 248 | | 10/1962 |
| FR | 1401396 | | 4/1965 |
| GB | 830094 | | 3/1960 |
| GB | 1164288 | | 9/1969 |
| JP | 57114215 | | 7/1982 |
| JP | 59104110 | | 6/1984 |
| JP | 4192510 | | 7/1992 |
| TW | 145021 | | 12/1989 |
| TW | 291177 | | 6/1996 |
| TW | 414900 | | 1/1999 |
| WO | WO 91/12960 | | 9/1991 |

* cited by examiner

*Primary Examiner*—Lincoln Donovan
*Assistant Examiner*—Jennifer A. Poker
(74) *Attorney, Agent, or Firm*—Greer, Burns & Crain, LTD

(57) ABSTRACT

A three-phase transformer is presented comprising a magnetic circuit and three coil block. The magnetic circuit comprises two spaced-apart, parallel, plate-like elements; and three spaced-apart, parallel column-like elementary circuits. Each of the column-like elementary circuits carries the corresponding one of the three coil blocks, and serves for the corresponding one of the three phases. The column-like elementary circuits are substantially perpendicular to the plate-like elements, and are enclosed therebetween such as to form a spatial symmetrical structure about a central axis of the transformer.

12 Claims, 8 Drawing Sheets

THREE-PHASE TRANSFORMER

FIELD OF THE INVENTION

This invention relates to a three-phase electrical transformer and a method for manufacturing thereof.

BACKGROUND OF THE INVENTION

A transformer is a known electrical device widely used for transferring energy of an alternating current in the primary winding to that in one or more secondary windings. It typically contains two or more electrical circuits comprising primary and secondary windings, each made of a multi-turn coil of electrical conductors with one or more magnetic cores coupling the coils by transferring a magnetic flux therebetween.

Presently known three-phase transformers usually utilize E+1 magnetic cores in a flat structure. Such a transformer includes several interconnected magnetic cores located in one plane. U.S. Pat. Nos. 4,893,400 and 5,398,402 disclose transformers having a magnetic core made of an amorphous metal strip wound into a core over a mandrel, with one leg of the resulting core being subsequently cut off and with forming the metal into a rectangular shape. This transformer is manufactured in the following manner. A piece of rectangular steel is wrapped around the outer periphery of the amorphous metal core. The amorphous metal is then annealed, and the core is encapsulated in a resinous coating, except the cut leg. This allows the opening of the cut leg. The layers of amorphous alloy strips of the two edges are oriented so that the edges define top and bottom surfaces, each surface having a discontinuity defining a distributed gap portion extending from the top surface to the bottom surface. The coils are placed over two long legs and the cut leg is closed. The joint is then sealed.

According to U.S. '400, the sealing is made with glass cloth and an ultraviolet-curable resin to provide the structure by the "fit and cure" method. This method is costly and labor-intensive. The transformers having amorphous metal cores manufactured according to this method cannot be repaired without causing damage to the core.

According to U.S. '402, the sealing is made with a porous material such as woven cotton cloth or paper. The porous material is folded over the joint and secured into position. An additional piece of porous material is placed through the window of the core, wrapped around the core and secured there. Electrical grade steel is disposed around the transformer core and is closed around the core joint and tack-welded. This structure allows the cut leg to be opened to permit replacement of a defective coil. The operation, however, is time-consuming and labor-intensive.

U.S. Pat. No. 5,441,783 discloses a technique of the kind specified, wherein a coating used to impregnate the core joint is a porous material with a viscosity greater than about 100,000 cps and a bonding material with a viscosity of at least about 100,000 cps. The porous material comprises strands of fiber, and the bonding material is thixotropic epoxy. Although the coated cores have good magnetic properties, their manufacture requires costly and complex operational steps. Moreover, the method of repairing these cores is labor-intensive.

Another common disadvantage of the transformers manufactured according to the techniques disclosed in the above patents is that annealed amorphous metals become extremely brittle, and thus break under mechanical stress, for example, during the stage of closing the core joint.

In the transformers of the above kind, a planar core structure is used. U.S. Pat. No. 4,639,705 discloses a transformer structure of another kind, having a spatial magnetic core system. This structure has advantages over the planar "E+1" structure, such as the reduced quantity of required magnetic materials (by about 20–30%), reduced volume of the transformer, reduced core losses (by about 20–30%), and balanced currents in the three phases of the primary windings. However, to manufacture a transformer in accordance with the technique disclosed in U.S. '705, complex production technology as well as a complex repair technology, are required.

SUMMARY OF THE INVENTION

It is accordingly a need in the art to facilitate the manufacture and maintenance of a three-phase transformer, by providing a novel electrical transformer structure and a method of its manufacturing.

It is a major feature of the present invention to provide such a transformer that has higher efficiency and smaller magnetic core, and that uses lower quantities of materials per unit electrical power and/or has better maintainability, as compared to those of the conventional transformers of this kind.

The main idea of the present invention consists of constructing a three-phase transformer having a spatial symmetrical structure of a magnetic circuit. The magnetic circuit comprises two spaced-apart, parallel plate-like elements, and three spaced-apart parallel column-like elementary circuits, which are substantially perpendicular to the plates and are enclosed therebetween forming a mutually symmetrical structure.

There is thus provided according to one aspect of the present invention a three-phase transformer comprising a magnetic circuit and three coil blocks, wherein the magnetic circuit comprises:

two spaced-apart, parallel, plate-like elements; and three spaced-apart, parallel column-like elementary circuits, each column carrying the corresponding one of said three coil blocks and serving for the corresponding one of the three phases, wherein the columns are substantially perpendicular to the plate-like elements and are enclosed therebetween such as to form a spatial symmetrical structure about a central axis of the transformer.

Preferably, each element of the magnetic circuit (i.e., plates and columns) is formed of an amorphous strip (e.g., ribbons of a soft ferromagnetic amorphous alloy) or a silicon steel strip. The plate-like element may be of a substantially triangular shape with rounded edges, or of a circular shape that simplifies the technological process of the manufacture of the plate-like element. The plate-like element may be a toroid.

Each of the column-like elementary circuits may be a toroid or several axially mounted toroids, each having a radial slot filled with an insulating material. Alternatively, each of the elementary circuits may be manufactured from a plurality of vertically aligned strips or ribbon pieces, in which case the cross section of the column is a polygon or a circle. The ribbon pieces are attached to each other, in such a manner that each ribbon piece is in a planar state and is oriented along the column.

The elementary circuits are spaced from each other and from the plate-like elements by insulating spacers. All the spacers may be formed of plastic with filler of a magnetic powder with the concentration of 20–50%.

Each of the toroids may be made of a set of amorphous strips having different widths. The alternation of the strips of different widths extends along the vertical axis of the toroid, and the strips of the adjacent layers are displaced from each other along the vertical axis in such a manner that the strips of one layer overlap the butts of the strips of the adjacent layer.

The working surfaces of the toroidal plates can be formed with annular concentric recesses, the butt-end surfaces of the vertical elements (columns) being formed with corresponding projections to be received by the recesses. The contacting surfaces of the recesses and projections should be coated with insulating materials.

The advantages of the present invention consist of the following. The provision of the plate-like elements of a triangular shape with rounded corners allows for effectively transferring the magnetic flux between the three column-like elementary circuits enclosed between the plates. The provision of the column-like elementary circuits formed by one or more toroids produced by wounding the amorphous strips, enables to obtain a desired height of the column irrespectively of the limited width of the strip. Moreover, the stacked structure of the column formed of several toroids provides good conductivity of the magnetic flux (low reluctance) along the column, while presenting high impedance to eddy currents. By forming the elementary circuit (column) with a radial slot, the eddy currents could be even more reduced. Actually, the introduction of the radial slot results in the induction of high voltage equivalent to that in one ribbon turn. Additionally, such a modular structure of the entire transformer simplifies its assembling and dismantling, thereby allowing the easy manufacture and maintenance of the transformer. Thus, by appropriately selecting the dimensions of the transformer's elements (e.g., the diameter of each column-like element and each of the plate-like elements), the desired properties of the transformer can be achieved.

According to another aspect of the present invention, there is provided a method for manufacturing a three-phase transformer, the method comprising the steps of:

(i) producing two substantially plate-like elements of a magnetic circuit of the transformer from materials having soft ferromagnetic properties;

(ii) producing three column-like elementary circuits of said magnetic circuit from materials having soft-ferromagnetic properties;

(iii) mounting a coil block on each of the column-like elementary circuits to form the corresponding one of the three phases of the transformer, (iv) mounting the column-like elementary circuits between the plate-like elements in a spaced-apart parallel relationship of the elementary circuits, such as to form a spatial symmetrical structure about a central axis of the transformer.

BRIEF DESCRIPTION OF THE DRAWINGS

In order to understand the invention and to see how it may be carried out in practice, a preferred embodiment will now be described, by way of non-limiting example only, with reference to the accompanying drawings, in which.

DETAILED DESCRIPTION OF A PREFERRED EMBODIMENT

Figure 1:
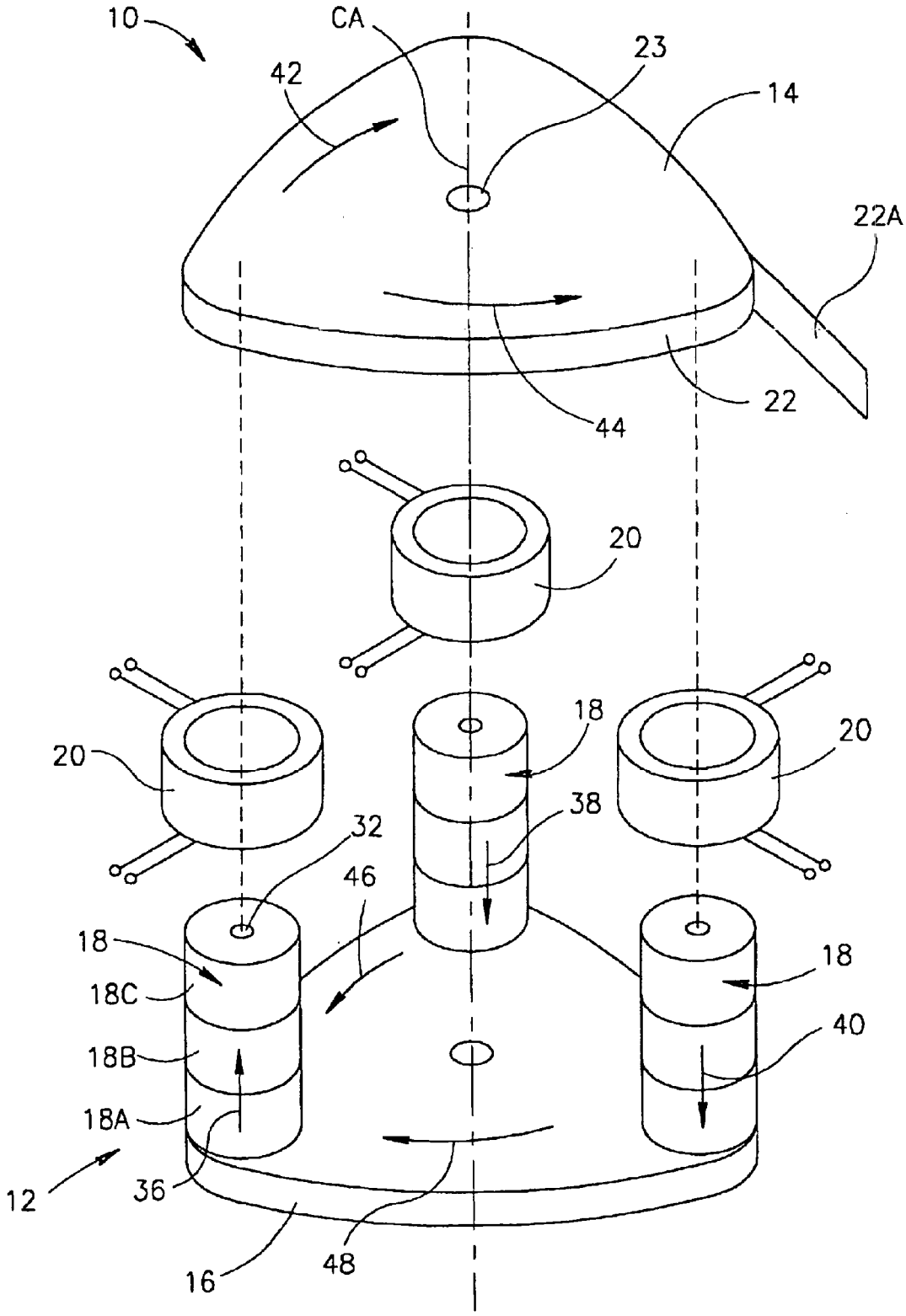
FIGS. 1 and 2 illustrate schematically exploded and assembled views of a three-phase transformer structure according to the invention.
Figure 2:
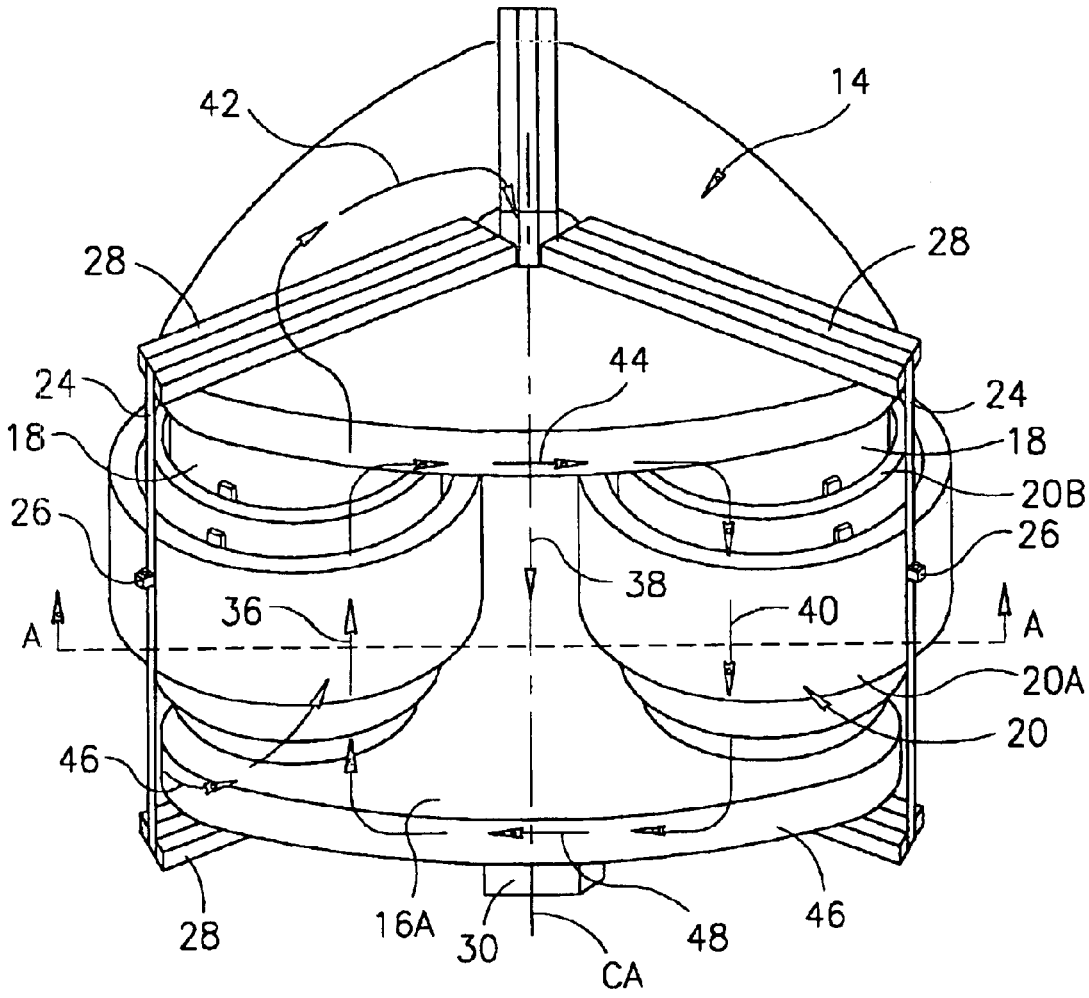

Referring to FIGS. 1 and 2, the main components of a three-phase transformer 10 constructed according to the present invention are illustrated. The transformer 10 comprises a magnetic circuit 12 formed by an upper plate-like element 14, a lower plate-like element 16, and three parallel identical column-like elementary circuits, generally at 18. The magnetic circuit 12 is arranged such that the plates 14 and 16 are parallel to each other, and the columns 18 serve as supports between the plates, thereby forming a cage-like structure spatially symmetrical about a central axis CA. In the present example, each of the plates 14 and 16 is a toroid, and is made of amorphous ribbons 22 wound about a central hole 23 to form the planar toroid. Further provided are three coil blocks 20, each for mounting on a corresponding one of the columns 18. As shown in FIG. 2, each of the coil blocks 20 includes a primary winding 20*a* and a secondary winding 20*b*. Thus, each phase of the transformer 10 is formed by the column-like elementary circuit 18 with the corresponding coil block 20 mounted thereon.

The transformer 10 has a modular structure, namely, the plates 14 and 16, and the columns 18 can be easily assembled together and disassembled, as will be described more specifically further below. When one of the plates 14 or 16 is removed, the coil blocks 20 can be removed as well, thereby enabling, for example, to repair the coil.

In the present example, each of the plates 14 and 16 has a generally triangular shape with rounded sides and corners. After forming the plate 14 of the desired shape and size, an excess-ribbon portion 22*a* is cut off. The amorphous ribbon 22 is made of an alloy having soft ferromagnetic properties, as required for the magnetic circuit of a transformer. Amorphous ribbon is known to have good ferromagnetic properties. The structure of the transformer 10 according to the invention allows for beneficial use of these properties in a practical transformer structure.

Each of the columns 18 is also a toroid, or a plurality of toroids stacked on top of each other—three toroids 18*a*, 18*b* and 18*c* in the present example. This construction enables to achieve a desired height of the column 18, notwithstanding the fact that the width of amorphous ribbon is typically limited. Thus, the present invention allows for producing a transformer with any desired height of the column-like elementary circuit 18 by stacking toroids of limited height on top of each other.

As shown in FIG. 2, the entire structure is held together with three de-mountable bands 24 (only two of them being seen in the figure), each having a screw (or spider) 26 to tighten the band. Structural members 28 are provided, each located between the corresponding one of the bands 24 and each of the plates 14 and 16. A base 30 supports the entire structure. An inner, upper surface 16*a* of the plate 16 is brought into contact with lower surfaces of the columns 18 to transfer magnetic fluxes therebetween, as will be described more specifically firer below.

Figure 3:
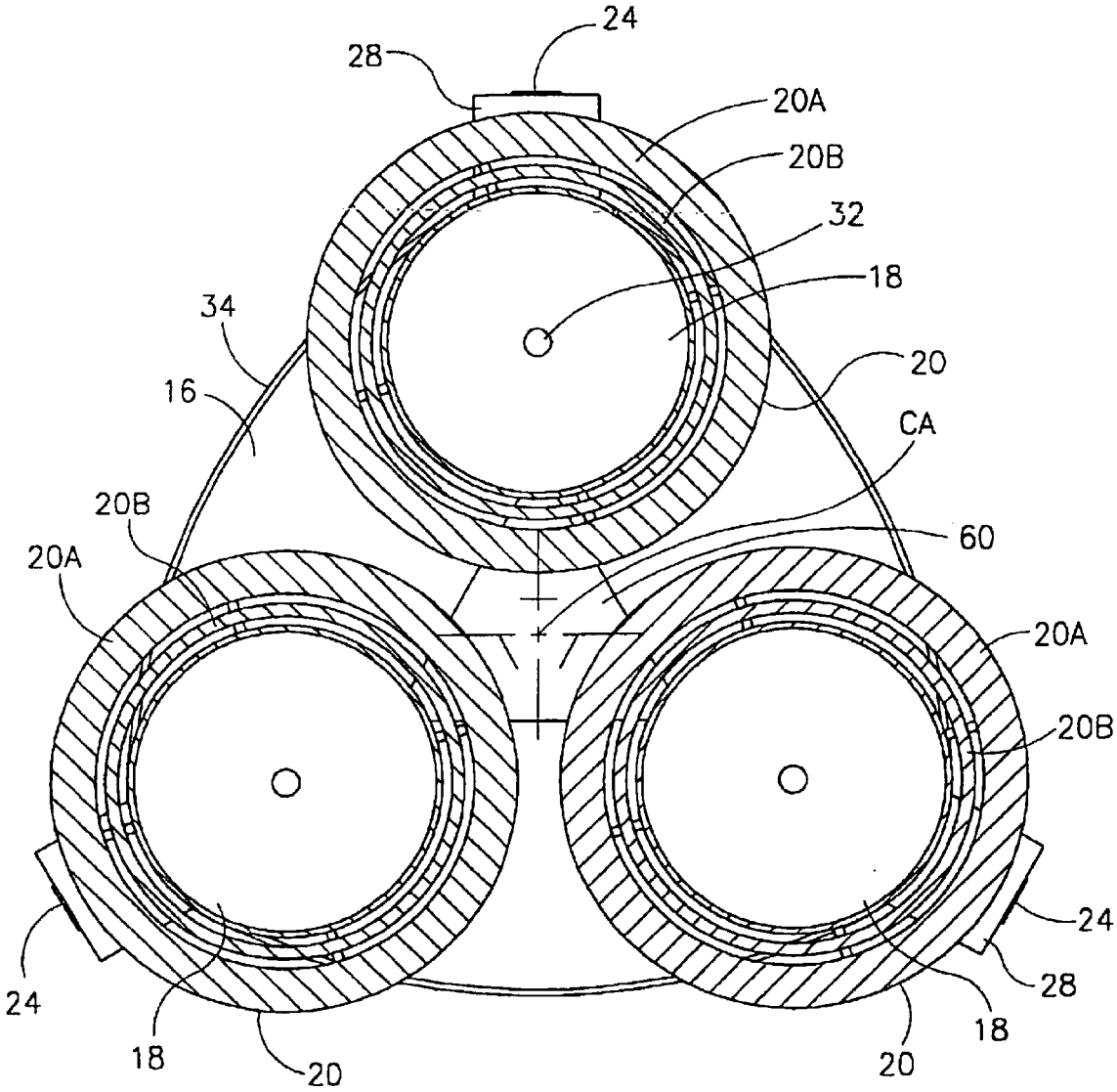
FIG. 3 is a section taken along lines A—A in FIG. 2.

FIG. 3 illustrates a section taken along line A—A of FIG. 2, showing more specifically the lower plate 16 and the three columns 18 of the magnetic circuit 12. Each column 18 is formed with a central hole 32, and the columns 18 are arranged symmetrically about the central axis CA. As shown, the structural member 28 is located between the corresponding one of the bands 24 and the plate 16. The plate 16 preferably has a protective coating 34 aimed at prolonging its life.

Turning back to FIGS. 1 and 2, the operation of the transformer 10 consists of the following. As a current passes through each primary winding 20*a* of the coil block 20, a magnetic flux is generated and propagates along the corresponding column 18 between the upper and lower plates 14 and 16. Arrows 36, 38 and 40 show fluxes generated in the three columns 18, respectively. The magnetic flux flowing through the column. 18 generates an induced voltage in the secondary winding 20*b* of the corresponding coil block 20. The device having this structure thus functions as a three-phase transformer.

Thus, the electric current, for example, with the working frequency of 50 Hz, is supplied from a power source (not shown) to a terminal of coil of the primary winding 20*a*, and, whilst passing through the coil turns, creates the basic magnetic flux 36. Let us now consider the moment of passing of the magnetic flux along one phase of the transformer. Assuming, for example, that at a given moment the flux 36 flows up. Then, the flux 36 is divided into two identical fluxes 42 and 44 in the plate 14. These fluxes 42 and 44 flow along two identical portions of the toroidal plate 14, and, then, flow down through the two other cores 18. The flux 42 changes into flux 38, and the flux 44 changes into the flux 40 passing down through the columns 18. Then, the fluxes 38 and 40 flow along two equal paths of the toroidal plate 16. Whilst passing along the toroidal plate 16, the flux 38 changes into a flux 46, and the flux 40 changes into a flux 48. The fluxes 46 and 48 are transferred into the column 18 forming the sum flux 36, which flows up. Thus, the magnetic flux loop is closed. The fluxes of the other phases of the transformer flow in the similar way summing up the total magnetic flux.

As indicated above, the plates 14 and 16 could have a circular shape. In this case, the flux steams 42, 44, 46 and 48 will flow along circular paths therein. In the example of FIGS. 1 and 2, each of the plates 14 and 16 is shaped like an equilateral triangle with rounded sides and corners. This results in a shorter path for the flux streams in the plates 14 and 16 between the columns 18, i.e., the shape of the flux streams is closer to a straight line. This enables to achieve a lower magnetic reluctance, or better conductance of the magnetic flux. A more efficient structure could be achieved by using a more raw material for the magnetic core. To manufacture each of thee plate-like elements 14 and 16, the amorphous ribbon 22 is secured to a mandrel of a triangular cross section, which is then rotated about its In axis. When the desired size of the plate 16 is achieved, the plate is fixed in that state using either impregnation or welding procedure, and the excess of ribbon 22*a* is cut off. Due to the triangular cross-section of the mandrel, the plate 16 has a generally equilateral triangle shape with rounded corners and sides.

Each winding in the coil block 20 is made of a copper wire. Each coil may have a winding and a case insulation compatible with the working voltage and cooling system used. If air-cooling is used, a relatively thick insulation may be required. In case the transformer is immersed in oil, a thinner insulation may be used for the same voltage. Oil may be used for cooling as well as for insulation between the windings.

The cross-sectional area of the column 18 and the corresponding area on the plates 14 and 16 are defined by the ferromagnetic property of the amorphous alloy these parts are made of, and by the transformer working voltage. The height of each column 18 and the distance between the columns is derived from the dimensions of the coil blocks 20, according to the cross-sectional area of the wires, the number of turns and the required insulation. The dimensions of the plates 14 and 16 are such as to form a base for the whole cross-sectional area of all the columns 18, when the columns 18 are located at the required distance therebetween. This allows the passage of the magnetic flux from the columns 18 to the plates 14 and 16.

In the present example, each of the toroids 14, 16, 18*a*, 18*b* and 18*c* is made of amorphous ribbon of about 20 mm in width and 25 $\mu$m in thickness. It should, however, be noted that the toroids 18*a*, 18*b* and 18*c* may be made from ribbons in the range of 10–100 mm wide, or as allowed by the ribbon manufacturing process.

Figure 4:
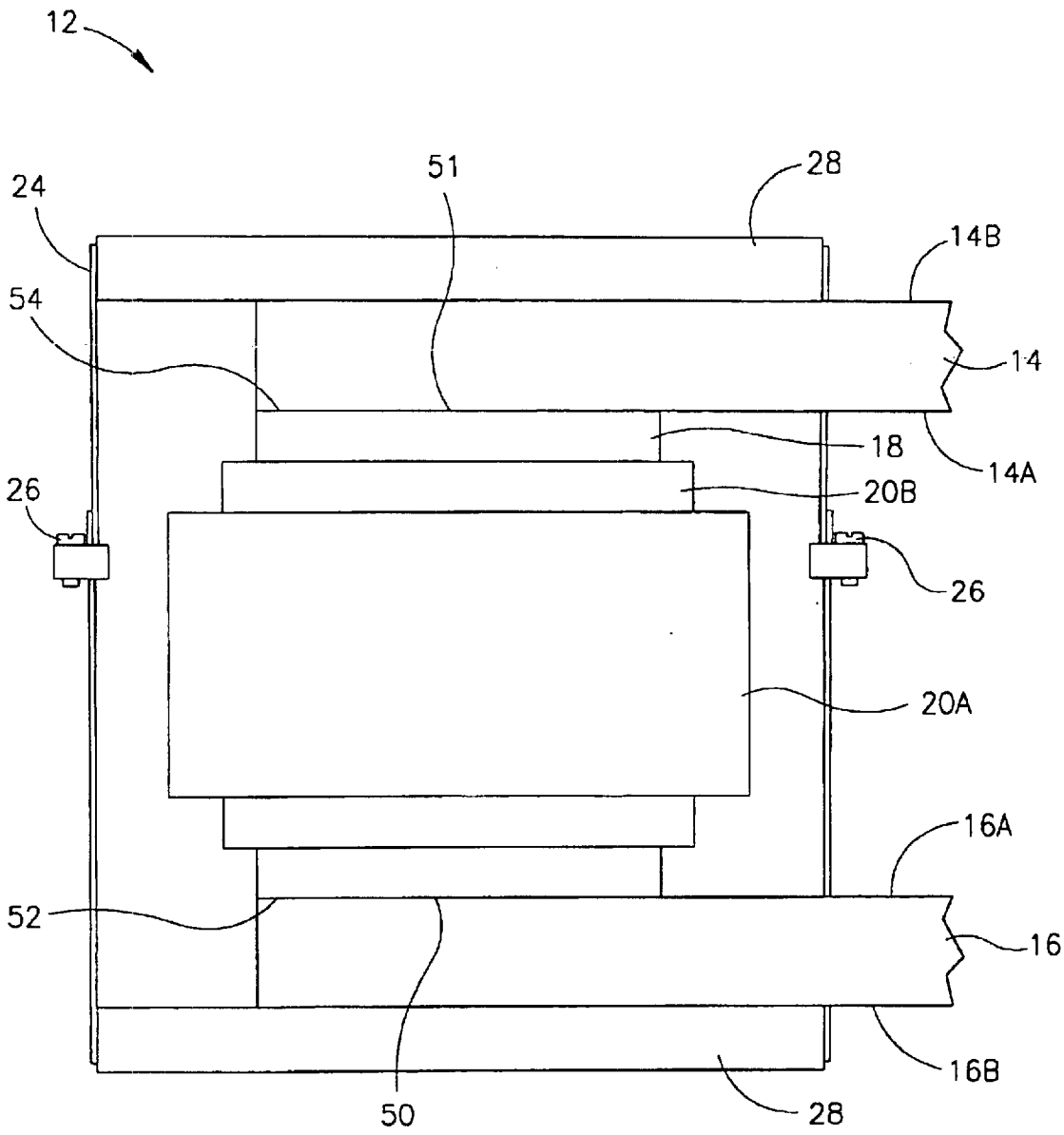
FIGS. 4 and 5 illustrate more specifically some constructional parts of the three-phase transformer of FIGS. 1–2, showing two possible examples, respectively, of assembling means for assembling the transformer.

FIG. 4 more specifically illustrates the column 18 of the magnetic core 12 of the transformer and means for assembling the transformer. The column 18 is mounted between the upper and lower plates 14 and 16. The primary and secondary winding 20*a* and 20*b* of the coil block 20 are mounted on the column 18. The structure is held together with the de-mountable bands 24 which are tightened with the screws 26. The structural member 28 is located between the band 24 and each of the plates 14 and 16. The de-mountable bands 24, screws 26 and structural members 28 constitute together the assembling means. It should be noted that the type and size of the assembling means could depend on the dimensions and rated power of the transformer.

As the inner (upper) surface 16*a* of the plate 16 comes in contact with a lower surface 50 of the columns 18 to transfer the magnetic fluxes in the transformer, a narrow air gap 52 may be created therebetween. The width of the gap 52 may, for example, be about 0.2 mm. This gap 52 should preferably be filled with a magnetic paste, to improve the overall ferromagnetic property of the magnetic loop, namely to decrease the magnetic resistance. The magnetic paste may include an amorphous powder with soft ferromagnetic properties, having particle size larger than 20 $\mu$m, and a binding insulating material like transformer oil or epoxy resin. The concentration of the amorphous powder in the paste is usually between 50% and 90%. Any other suitable means can be used to minimize the gap 52 and its influence on the magnetic loop. An outer (lower) surface 16*b* of the plate 16 may be formed with a protective coating.

Similarly, a narrow air gap 54 may be created between a surface 14*a* of the element 14 and an upper surface 51 of the column 18. The gap 54 should also be filled with a magnetic paste. An outer (upper) surface 14*b* of the plate 14 should preferably also be formed with a protective coating.

Figure 5:
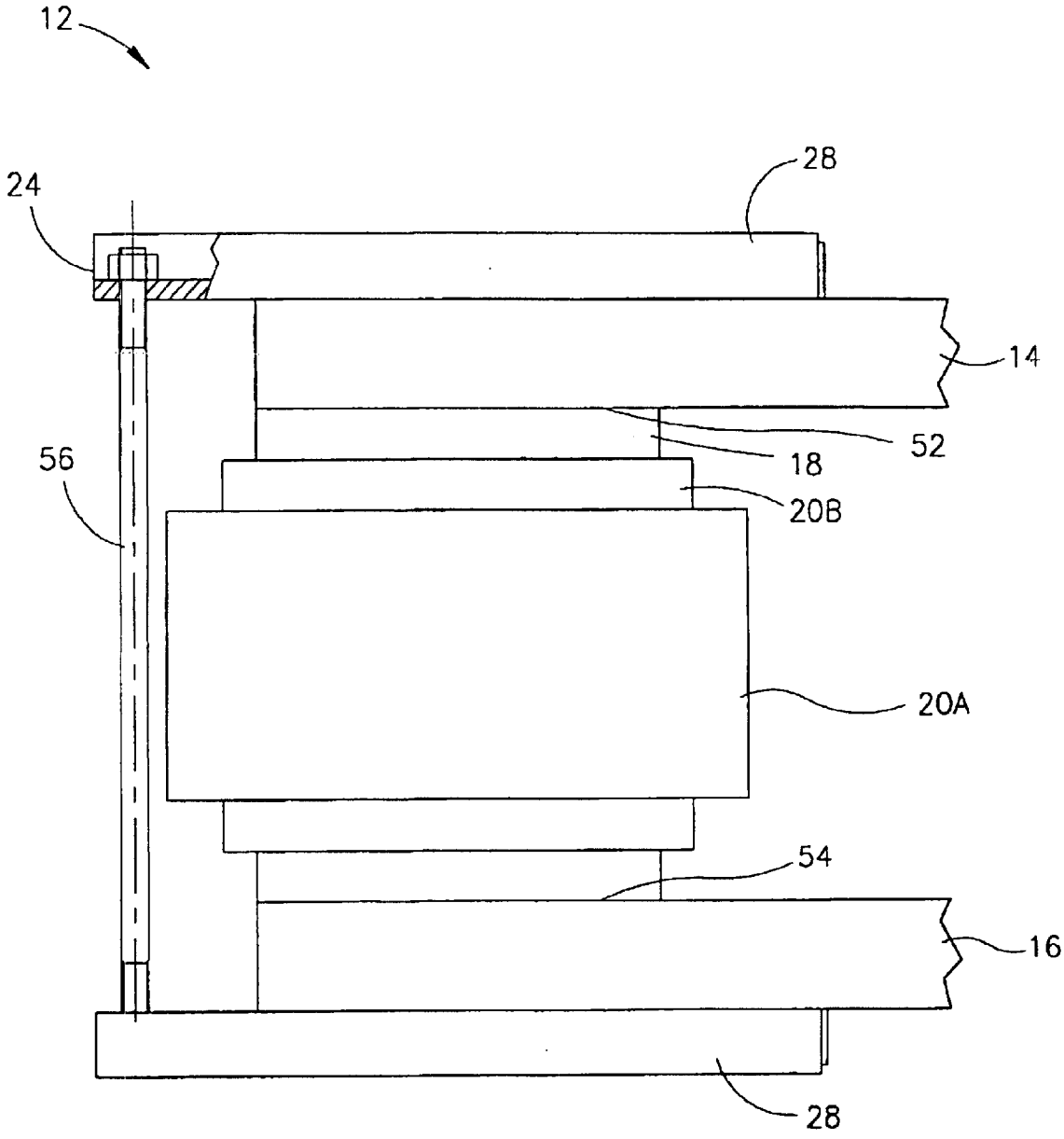

FIG. 5 illustrates one of the columns 18 of the magnetic circuit 12 associated with a somewhat different assembling means, as compared to that of the example of FIG. 4. To facilitate understanding, the same reference numbers are used for identifying those components, which are identical in the examples of FIGS. 4 and 5. Here, the upper and lower plates 14 and 16 and the column 18, are held,together by a threaded beam or screw 56. The structural members 28 that are attached to each of the plates 14 and 16 include means adapted for the thread and nut structure.

It is important to note that, when manufacturing transformers of various power, one comes into conflict caused by the absence of strips made of amorphous materials with arbitrary width, and by the need for a magnetic circuit element having the height much larger than the strip's width. For example, the presently available strips have the width of 70 mm, while the required height of the toroid-like plate 14 (and 16) is 90 mm. To solve this problem, the toroid can be produced by winding the strips of different widths, the total width of the strips being equal to the height of the toroid. The strips in the adjacent layers of the toroid are displaced from each other such that the strips of one layer overlap a gap between the strips of the adjacent layer. Due to this winding technique, a toroid having desired dimensions can be obtained. In this toroid, the even distribution of a magnetic flux is observed.

Figure 6:
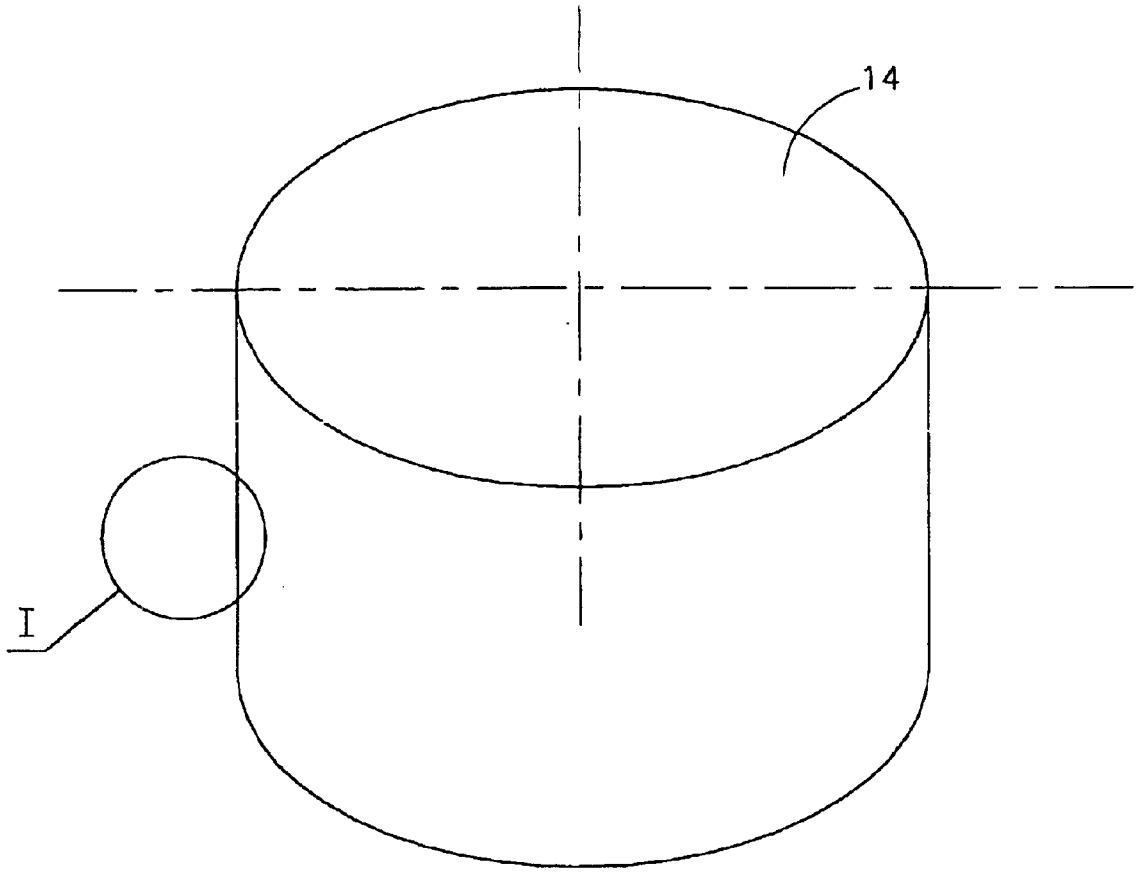
FIG. 6 illustrates the principles of manufacturing the column-like elementary circuit of the transformer of FIGS. 1–2, utilizing amorphous ribbon strips of different widths.
Figure 6:
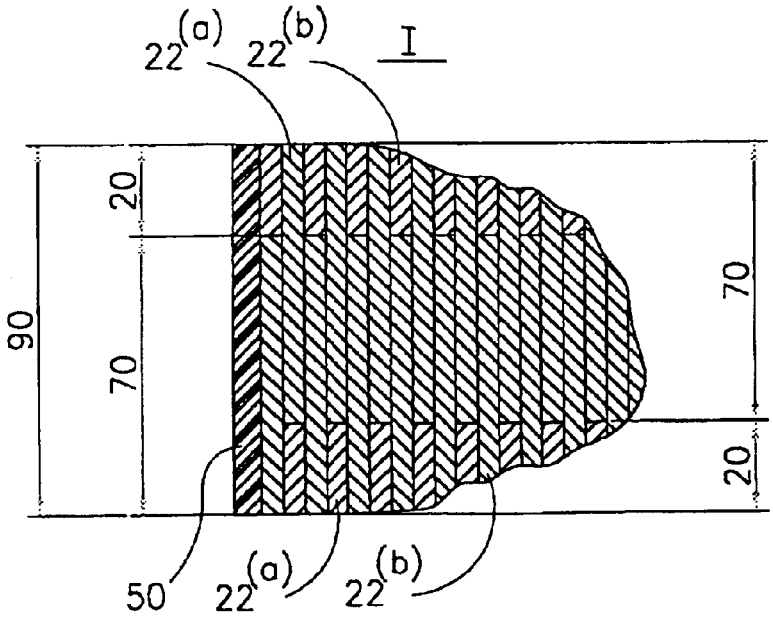

As illustrated in the example of FIG. 6, a winding of a 90 mm height toroid is carried out from strips $\mathbf{22}^{(a)}$ having the width of 70 mm and strips $\mathbf{22}^{(b)}$ having the width of 20 mm. The strips are located on four coils of a winding device (not shown), from which the strips $\mathbf{22}^{(a)}$ and $\mathbf{22}^{(b)}$ are sequentially supplied to the first layer, and the strips $\mathbf{22}^{(b)}$ and $\mathbf{22}^{(a)}$ are sequentially supplied to the second layer. In this case, the toroid winding is carried out in two layers simultaneously, each successive layer overlapping the gap between the strips of the adjacent layer.

Figure 7:
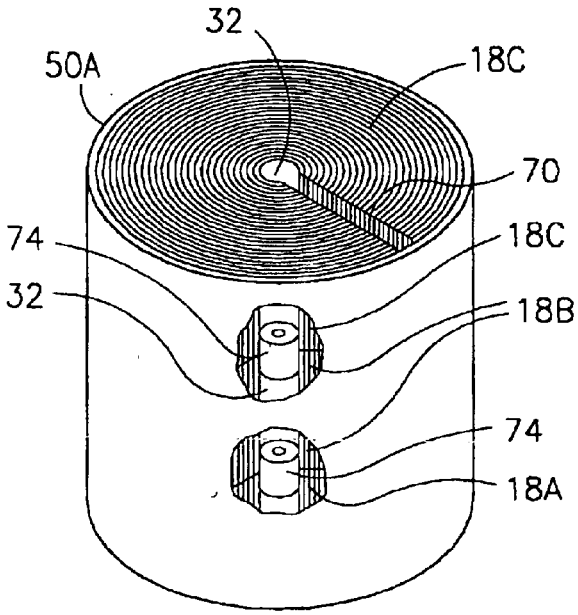
FIG. 7 more specifically illustrates the structure of the elementary circuit of the transformer of FIGS. 1–2, utilizing a plurality of toroids.

Reference is made to FIG. 7, more specifically illustrating the structure of the column-like elementary circuit 18. In the present example, the column 18 is formed by the three toroids 18*a*, 18*b* and 18*c*. It should, however, be understood that the column 18 could be in the form of a single toroid. The column 18 can be fabricated similarly to the plates 14 and 16, namely from several strips of different widths. All the toroids 18*a*, 18*b* and 18*c* (or the single toroid) are formed with the central hole 32. An outer cover 50*a* of the toroid is preferably made of an insulating material, for example, a glass-cloth laminate impregnated with an epoxy resin. The toroids 18*a*, 18*b* and 18*c* are made of amorphous ribbon, and preferably have a radial slot 70 to decrease losses and to prevent high voltages from being induced into the windings of the toroids. Such a high voltage may cause breakdown of the insulation between the adjacent layers of the toroid. The radial slot 70 may, for example, be of 1 mm in width, or of any other appropriate width for a specific transformer design. The slot 70 may be made with a corundum disk (not shown) of 200 mm diameter and 0.5–1 mm thickness, using a cooling liquid and the toroid secured in a suitable fixture. The slot 70 is preferably filled with an insulating material, for example a glass-cloth-base laminate. In the present example, cylinders 74 made of an insulating material are inserted into the hole 32, so as to align together the toroids 18*a*–18*b* and 18*b*–18*c*. The cylinders 74 may have a central hole, to allow the insertion of a threaded beam (not shown).

One of the parameters characterizing the operation of a transformer is the idle current. This value depends on the characteristics of the magnetic materials used and the values of the air gaps 52 and 54 (FIG. 4) between the separate parts of the magnetic circuit. The affect of the air gap can be reduced in the following manner:

The air gaps 52 and 54 are filled with a magnetic paste or with a spacer made of plastic having a filler of magneto-conductive powders, for example, amorphous iron-based powders. The thickness of such a spacer may, for example, be 0.1–0.2 mm. The induction in the air gap is reduced, which can be achieved by increasing the cross sectional area of the air gap, through which the magnetic flux passes, by several times.

Figure 8:
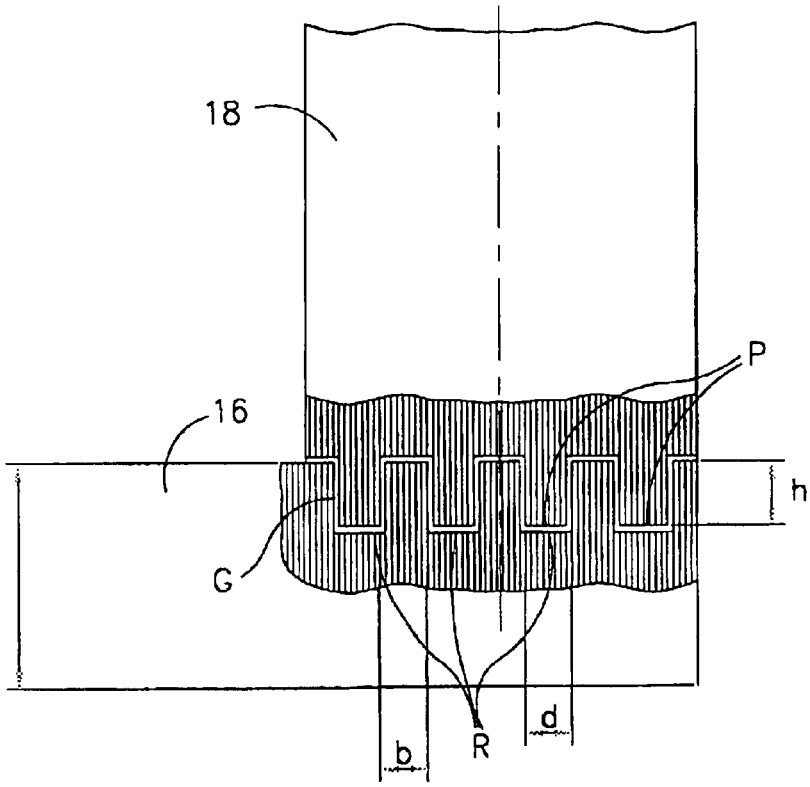
FIG. 8 more specifically illustrates the structure of the end surfaces of the plate-like element and elementary circuit, showing the place of joint thereof.

FIG. 8 illustrates one possible example of the implementation of the spacer. Here, annular, concentric recesses R are made in the working surfaces 16*a* and 14*a* of the toroid plates 14 and 16 (only the plate 16 being shown in the figure). In the present example, the recesses R have the thickness d of 3 mm and the depth h of 6 mm, the pitch b between the adjacent recesses R being 3 mm. Butt-end surfaces of the elementary circuits 18 are formed with corresponding projections P to be received by the recesses R. The surfaces of the recesses R and projections P should be coated by an insulating material, such that an air gap G, for example of 0.05 mm, is maintained between the side surface of each projection P and the side surface of the recess R.

Figure 9:
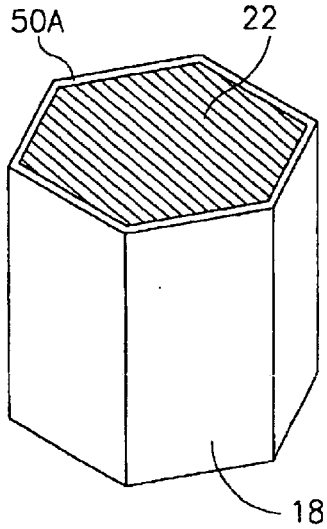
FIG. 9 more specifically illustrates the structure of the elementary circuit of the three-phase transformer, including longitudinally oriented ribbon parts.

FIG. 9 exemplifies the column-like elementary circuit 18 of the three-phase transformer formed from the longitudinally oriented amorphous ribbon pieces 22. The ribbon pieces 22 may have the same width, e.g., 50 mm, or various width values. In the present example, the 25 $\mu$m thickness ribbon pieces are used, although other thickness values are suitable as well. It should be noted that the cross-section of the column 18 may have rectangular or polyhedral shape. The main advantage of this design is that the long column 18 may be obtained without the need to stack parts thereof one on top another, as in the previously described examples. The elementary circuit 18, formed of the longitudinally oriented ribbon pieces 22, is produced in the following manner:

An amorphous ribbon made of a ferromagnetic alloy is cut to pieces 22, each having the length equal to the height of the column 18 to be obtained. The cutting may be with the ±0.5 mm precision, and the burrs are filed off. The width of the ribbon pieces 22 is set in accordance with the required cross-sectional dimensions of the column 18. The ribbon pieces 22 are stacked in an annealing fixture (not shown) to form the column with the desired dimensions. The fixture includes a pressing means for pressing the pieces 22 together to achieve the desired coefficient of density, which is about 0.8–0.9. Annealing of the complete column 18 in its fixture at the temperature of about 350–550° C. is, preferably, performed in a furnace with controlled atmosphere, for a time period of less than one hour. The annealing procedure may be performed with or without the application of an external magnetic field to the column. Should the application of the external magnetic field be used, such a field may be either longitudinal or transversal. Impregnation of the annealing package with an organic binding material, for example an epoxy resin, is performed in a vacuum chamber or in an ultrasonic bath. The impregnation may be carried out with the pieces 22 being in the annealing fixture. The column is placed in a thermostat and sintered at the temperature of about 80–105° C. Then, the column is removed from the fixture, and the excess of the binding material is removed from the planar surfaces at the top and bottom of the column.

To achieve better mechanical strength, the lateral surface of the column is coated with a glass-cloth-base laminate band impregnated with epoxy resin that is wound about the column. After coating, the band is sintered at the temperature of about 100–130° C. To provide sufficiently good magnetic properties and allow for fitting the elements close to each other (when assembling the column), the upper and lower surfaces of the column may be milled and polished to within 0.1 mm, with the total length of the column being set to within a 0.1 mm tolerance. To prevent stratification of the column during the machining process, it is necessary to chuck the operated zone in a special fixture.

Figure 10:
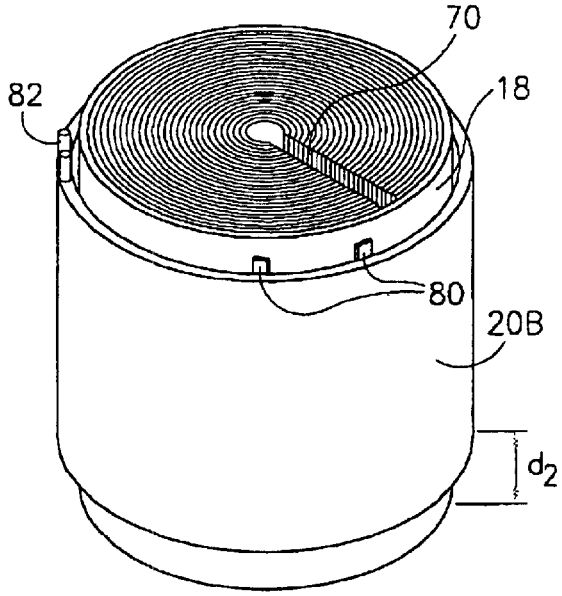
FIGS. 10 and 11 illustrate two stages in a method of assembling the structure of the elementary circuit of the transformer of FIGS. 1–2.
Figure 11:
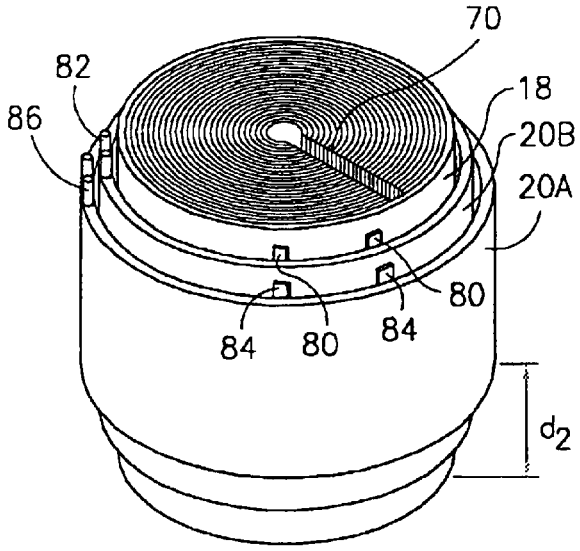

FIGS. 10 and 11 illustrate the main principles of assembling the transformer 10. FIG. 10 shows the structure of the column 18 after mounting the first coil of the coil block 20 (i.e., the secondary winding 20*b*) thereon. Spacers 80 made of an insulating material are used to mechanically attach the winding 20*b* to the column 18, while keeping the parts electrically insulated from each other. Terminals 82 of the winding 20*b* are exposed to allow electrical connections thereto. During the formation of the structure, a specific distance $d_1$ is kept between the lower end of the winding 20*b* and the lower end of the column 18. The structure is symmetrical, having the same distance $d_1$ at the upper end of the winding 20*b*.

FIG. 11 shows the transformer 10 with both primary and secondary windings 20*a* and 20*b* of the coil block 20 mounted thereon. The primary winding 20*a* is secured to the secondary winding 20*b* by spacers 84. The spacers 80 and 84 are made of an insulating material. Terminals 82 and 86 are used to connect the secondary and primary winding 20*b* and 20*a*, respectively, to a power source and load (not shown).

Thus, the entire assembling procedure is performed in the following manner. The coil of the secondary winding 20*b* is mounted on the column 18 and secured thereon with the spacers 80. Then, the coil of the primary winding 20*a* is mounted on that of the secondary winding 20*b* and secured thereon with spacers 82, the coil 20*a* being located in such a manner as to keep a predefined distance $d_2$ from each of the ends of the column 18. The coils of the other two phases are mounted on the corresponding columns 18 in a similar manner.

Turning back to FIG. 2, the plate 16 is set in a horizontal position with the working surface 16*a* pointing upwards. This working surface is the planar surface of the toroid 16 that was previously cleaned from the excess of the impregnating material and, optionally, polished.

Thereafter, a layer of the magnetic paste, having the thickness about 0.2 mm, is deposited on the plate 16 in the areas where the columns 18 are to be mounted. The three columns 18 with coil blocks thereon are mounted on the plate 16 symmetrically about the central axis CA. Then, another layer of the magnetic paste, having the thickness about 0.2 mm, is deposited onto the upper surfaces of the columns 18, and the upper plate 14 is mounted on the three columns 18 to complete the structure.

As described above, the elements 14, 16 and 18 of the magnetic circuit 12 are secured to each other using three de-mountable bands 24 with the screws 26 to tighten each band. The structural members 28 made of an insulating material are located between the bands 24 and the plates 14 and 16. The screws 26 are rotated so as to tighten the bands, thus securing the transformer parts together. Rotating the screws 26 in the opposite direction can easily dismantle the transformer. The bands 24 become loose and allow the removal of the columns 18 and the plates 14 and 16. Each coil can be then removed from its column, if desired.

The above technique allows for multiple cycles of dismantling/assembling the transformer, without causing any damage to the constructional parts of the transformer. This may facilitate the repair of the transformer, and may save work and materials needed therefor.

Various parts of the transformer may be separately and concurrently produced, and then assembled together in the final step. The entire method of manufacturing the transformer consists of the following.

Initially, the amorphous ribbons 22 are produced from an alloy having soft ferromagnetic properties, as will be described more specifically further below. Then, the elements (e.g., toroids) 14, 16, 18*a*–18*c* of the magnetic circuit 12 are produced. Each column-like elementary circuit 18 may comprise one or several toroids, according to the required height of the column 18 and the width of each toroid. In the case that the column 18 includes several toroids, each of the columns is assembled from these toroids. The coil block 20 is assembled (in the above-described manner), each including the primary and secondary windings 20*a* and 20*b*. Alternatively, each winding may be separately produced and assembled as a separate unit. Then, the impregnation and/or coating of the elements and/or at windings are carried out. To assemble the transformer from the so-produced elements, the columns 18 are inserted into the corresponding coil blocks 20, the coils are secured in place, the columns 18 are mounted at the corners of the plate 16, and the plate 14 is mounted on the columns 18. All the constructional parts 14, 16 and 18 are secured together using screws, tension bands or similar mechanical means.

The preparation of the amorphous ribbon toroids will now be described. At present, to obtain sufficiently good magnetic properties, the as-cast amorphous ribbons are annealed at a temperature of about 350–550° C. The disadvantage of this known method is that the amorphous ribbons become extremely brittle after annealing, usually breaking under mechanical stress or during winding of a toroid. To overcome this deficiency, the present invention utilizes the following preparation scheme:

Coating an as-cast amorphous alloy ribbon with an insulating layer. The thickness of the two-sided insulation needs to be no more than about 5 $\mu$m. It should, however, be noted that for a low-voltage transformer, this stage may be omitted;

Winding of a toroid (like the toroids 14, 16, 18*a*–18*c*) from the as-cast ribbon. The winding procedure is carried out as described above, by using the steel mandrel. For the parts 14 and 16, the cross-sectional area of the mandrel 60 is triangular, and the mandrel thickness is preferably substantially equal to the width of the ribbon to be wound. The mandrel 60 should have rounded corners to prevent cracks in the amorphous ribbon, for example corners with the radius about 10 mm. For the toroids 18*a*, 18*b* and 18*c*, a cylindrically shaped mandrel is used. The mandrel's diameter depends on the dimensions of the toroids to be manufactured, and may be in the range of about 10–30 mm. The mechanical tension in the ribbon is set according to the required winding density coefficient, which usually is about 0.8–0.9. To force the layers of the toroid to be laid exactly on top each other, the mandrel may have cheeks or delimiters mounted thereon. Using this scheme, the variation in toroid's width may be limited to a small value, for example about ±0.2 mm.

The last layer of the toroid is secured to the adjacent layer to prevent the toroid from unfolding. This may be achieved, for example, by using resistance welding.

Annealing of the complete toroid at a temperature of about 350–550° C., preferably in a furnace with controlled atmosphere, for a desired time period defined by the type of metal. The toroid may be annealed with the mandrel still inserted therein. Annealing may be performed with or without the application of an external magnetic field (longitudinal or transverse) to the toroid.

Impregnation of the toroid with an organic binding material, for example, an epoxy resin in a vacuum chamber or in an ultrasonic bath. After the impregnation, the toroid is placed in temperature-controlled environment. The impregnation may be performed with the mandrel still in the toroid.

The mandrel is removed from the toroid. The excess of an impregnation material is removed from the planar surfaces of the toroid, or at least the surface of one of the elements 14 and 16. The working surfaces (areas used to transfer the magnetic flux) may be polished to obtain planar surfaces for good flux transfer and low magnetic resistance; The ends of the toroid may be made parallel to within 0.2 mm. It should be noted, that the polishing procedure can be performed prior to the step of annealing, while the toroid already has a fixed shape, and the amorphous ribbon is not yet brittle and is thus more workable.

As described above with reference to FIG. 7, for the toroids 18*a*, 18*b* and 18*c*, the radial slot 70 may be cut in the toroid. The Slot 70 may be made with a corundum disk (not shown) of a 200 mm diameter and 0.5–1 mm thickness, for example, by using a cooling liquid and with the toroid secured in a suitable fixture. The slot 70 is preferably filled with an insulating material, for example, a glass-cloth-base laminate.

To achieve better mechanical strength, the lateral circular area of the toroid is coated with a glass-cloth-base laminate band that is wound about the toroid. After the coating procedure, the band is sintered at the temperature of about 100–130° C.

It should be noted that all the magnetic circuits in the transformer having the above construction could be manufactured not only from amorphous materials, but also from silicone steel. Although this leads to the increased losses in the magnetic circuit, it enables to simplify the technological process, owing to the fact that a strip of the required width can be selected for manufacturing the toroid. Therefore, the above construction utilizing silicone steel can be used in the applications having reduced requirements to the effectiveness of the transformer.

The technological process of the manufacture of the magnetic circuit from silicone steel consists of the following:

The toroidal plate (14 and 16) is wound from the strip produced from silicone steel having, for example, the width of 0.3 mm and an insulating coating of 3–10 $\mu$m thickness. In this case, the coefficient of the winding density lies in the range of 0.8–0.96. The width of the strip corresponds to the height of the toroidal plate.

After the winding procedure, the plate is impregnated by an insulating varnish, e.g., vacuum or ultrasound impregnation. The varnish solidifies at the temperature of 80–105° C.

A bandage made of a glass-strip is wound along the perimeter of the plate, and then impregnated by epoxide varnish with further thermo-treatment at the temperature of 80–105° C.

The working surface of the plate is treated, e.g., milled, for obtaining a plane with the unevenness value not exceeding 10 $\mu$m.

The column like elementary circuits 18 can be manufactured similar to the toroidal plates 14 and 16, or, alternatively, similar to a linear magnetic circuit (FIG. 9). When using the toroid manufacturing technology, the width of the strip is selected to be larger than the height of the column on the allowance value of mechanical treatment, e.g., 2 mm. The mechanical treatment of both butt-ends of the column 18, in distinction to that of the plate 14 and 16, is performed with the unevenness value not exceeding 10 $\mu$m and the unparallelism of the butt-ends not exceeding 20 $\mu$m. Moreover, the longitudinal slot 70 (e.g., of 1 mm in thickness) is made, and a plate (not shown) made of an insulating material, for example glass-textolite (resin-dipped fabric laminate), is inserted into the slot 70. A bandage made of a glass-strip is wound on the outer surface of the column, and then impregnated by epoxide varnish with further thermo-treatment at the temperature of 80–105° C.

When manufacturing the column 18 in accordance with the construction shown in FIG. 9, the silicone steel strips are set in the form of packets of different widths forming a polygon or a circle in the cross section. The length of the strip is selected to be larger than the height of the magnetic circuit on the allowance value of mechanical treatment, e.g., 2 mm. The assembled columns are impregnated by an insulating varnish, e.g., epoxide, and undergo thermo-treatment under the temperature of 80–105° C. A bandage of a glass-strip wound on the column along its perimeter is impregnated by epoxide varnish and dried at the temperature of 80–105° C. Thereafter, mechanical treatment of the butt-ends is performed with the unevenness value not exceeding 10 $\mu$m and unparallelism of the butt-ends not exceeding 20 $\mu$m.

Following are the calculation results corresponding to the transformer of 400 kVA power having the above design of assembling the separate parts of the magnetic circuit 12 to each other:

the cross sectional area of the column-like elementary circuit, $S_{core}$=293 cm$^2$;

the surface area of the projections having the height of 6 mm in at the butt-end of the column, $S^1$=469 cm$^2$;

the butt-end surface area of the projections, $S^2$=150 cm$^2$;

the total area on the projections, along which the magnetic flux passes, $S_\Sigma$=619 cm$^2$.

In this case, for magnetic induction, we have:

$$B_\delta = \frac{B_m \cdot S_{core}}{S_\Sigma}$$

wherein $B_m$ is the induction in the column. When $B_m$=1.3 (T), $B_\delta$=(1.3×293)/619=0.61(T), which results in the reduction of idle current by two. When selecting the depth of the recess equal to 12 mm, the idle current reduces by 4.

Mathematical analysis of a transformer made according to the present invention was performed, and results were compared to those for a conventional transformer having an "E+1" magnetic circuit structure. The evaluation relates to the transformer having rated power values of 10 kVA, 25 kVA, 100 kVA and 630 kVA. The analysis includes computation of the core and winding electrical losses and weight. All calculations were performed for a fixed, predefined value of overall efficiency. Calculation results are presented below in Tables 1 to 5.

Following are the parameters, which are common to all the tables 1–5:

f=50 Hz, wherein f is the working frequency;

three phase transformer;

Following are the variables in the tables 1–5:

$P_W$, wherein W is the winding loss;

magnetic circuit loss $P_{Fe}$ (W);

winding weight $G_W$ (kg);
magnetic circuit weight $G_{Fe}$ (kg);
total transformer weight $G_{tr}$ (kg);
efficiency η (%);
transformer height $B_{tr}$ (mm);
transformer length $L_{tr}$ (mm);
transformer width $B_{tr}$ (mm);
transformer volume $V_{tr}$ ($m^3$);
output power $P_2$ (kVA);
primary voltage $U_1$ (V);
secondary voltage $U_2$ (V)

TABLE 1

$P_2$ = 10 kVA; $U_2$ = 220 V; $U_1$ = 380 V

| Parameters | Type of transformer | |
|---|---|---|
| | AMT, dry - Israel | TSZM-10/0.4 |
| Core design | Toroid | E + 1 type |
| Core material | Amorphous metal | Silicon steel |
| $P_W$ (W) | 330 | 256 |
| $P_{Fe}$ (W) | 12 | 78 |
| $G_W$ (KG) | 26 | 59 |
| $G_{Fe}$ (kG) | 58 | 40 |
| $G_{tr}$ (KG) | 85 | 99 |
| η (%) | 96.7 | 96.7 |
| $H_{tr}$ (mm) | 214 | 465 |
| $L_{tr}$ (mm) | 349 | 600 |
| $B_{tr}$ (mm) | 349 | 335 |
| $V_{tr}$ ($m^3$) | 0.026 | 0.093 |

TABLE 2

$P_2$ = 25 kVA; $U_2$ = 220 V; $U_1$ = 380 V

| Parameters | Type of transformer | |
|---|---|---|
| | AMT, dry - Israel | TSZM-25/0.4 |
| Core design | Toroid | E + 1 type |
| Core material | Amorphous metal | Silicon steel |
| $P_W$ (W) | 697 | 558 |
| $P_{Fe}$ (W) | 19.3 | 157 |
| $G_W$ (KG) | 64.5 | 133 |
| $G_{Fe}$ (kG) | 95.5 | 77 |
| $G_{tr}$ (KG) | 160 | 200 |
| η (%) | 97.2 | 97.2 |
| $H_{tr}$ (mm) | 242 | 555 |
| $L_{tr}$ (mm) | 441 | 706 |
| $B_{tr}$ (mm) | 441 | 463 |
| $V_{tr}$ ($m^3$) | 0.047 | 0.18 |

TABLE 3

$P_2$ = 100 kVA; $U_2$ = 380 V; $U_1$ = 22.5 kV

| Parameters | Type of transformer | |
|---|---|---|
| | AMT dry - Israel | Siblok, dry |
| Core design | Toroid | E + 1 type |
| Core material | Amorphous metal | Silicon steel |
| $P_W$ (W) | 2024 | 1700 |
| $P_{Fe}$ (W) | 48 | 440 |
| $G_W$ (KG) | 132 | 160 |
| $G_{Fe}$ (kG) | 238 | 405 |
| $G_{tr}$ (KG) | 371 | 565 |
| η (%) | 97.9 | 97.9 |
| $H_{tr}$ (mm) | 706 | 1180 |
| $L_{tr}$ (mm) | 1270 | 1300 |

TABLE 3-continued $P_2$ = 100 kVA; $U_2$ = 380 V; $U_1$ = 22.5 kV

| Parameters | Type of transformer | |
|---|---|---|
| | AMT dry - Israel | Siblok, dry |
| $B_{tr}$ (mm) | 1270 | 925 |
| $V_{tr}$ ($m^3$) | 1.13 | 1.41 |

TABLE 4

$P_2$ = 630 kVA; $U_2$ = 380 V; $U_1$ = 22.5 kV

| Parameters | Type of transformer | |
|---|---|---|
| | AMT dry - Israel | Siblok, dry |
| Core design | Toroid | E + 1 type |
| Core material | Amorphous metal | Silicon steel |
| $P_W$ (W) | 7071 | 5600 |
| $P_{Fe}$ (W) | 136 | 1600 |
| $G_W$ (KG) | 650 | 570 |
| $G_{Fe}$ (kG) | 683 | 1740 |
| $G_{tr}$ (KG) | 1333 | 2310 |
| η (%) | 98.87 | 98.87 |
| $H_{tr}$ (mm) | 866 | 1850 |
| $L_{tr}$ (mm) | 766 | 1820 |
| $B_{tr}$ (mm) | 766 | 1186 |
| $V_{tr}$ ($m^3$) | 0.51 | 4.05 |

TABLE 5

$P_2$ = 630 kVA; $U_2$ = 380 V; $U_1$ = 22.5 kV

| Parameters | Type of transformer | |
|---|---|---|
| | AMT; dry - Israel | Allied Signal, Oil, USA |
| Core design | Toroid | E + 1 type |
| Core material | Amorphous metal | Amorphous metal |
| $P_W$ (W) | 5880 | 5835 |
| $P_{Fe}$ (W) | 148 | 186 |
| $G_W$ (KG) | 537 | 487 |
| $G_{Fe}$ (kG) | 739 | 932 |
| $G_{tr}$ (KG) | 1276 | 1419 |
| η (%) | 99.05 | 99.05 |
| Oil | – | + |
| Tank | – | + |

The computations for the transformers having various power ratings and voltage levels indicate the advantageous features of the transformer constructed according to the present invention, including among others the following features:

decrease of total weight by about 14% to 43%;
decrease in cost by about 3%–22%;
decrease in transformer volume by about 20% to 87%.

An experimental transformer manufactured according to the present invention has the following parameters:

$P_2$=1 kVA; $U_1$=380 V; $U_2$=220 V; $f$=50 Hz; η=92.66%; $G_{tr}$=16.4 kg

It was found that this transformer has good maintainability, and the above-described modular structure thereof enables its easy dismantling and reassembling, while the conventional transformer of the kind specified has the following characteristics: η=91% and $G_{tr}$=20 kg. It is thus evident that the structure according to the invention enables to achieve the 18% decrease in the transformer weight at higher efficiency.

Those skilled in the art will readily appreciate that various modifications and changes can be applied to the preferred embodiments of the invention as hereinbefore exemplified without departing from its scope defined in and by the appended claims.

What is claimed is:

1. A method for manufacturing a three-phase transformer, the method comprising:

(i) producing two substantially plate-like elements of a magnetic circuit of the transformer from amorphous strips, wherein each of the plate-like elements being produced as a planar toroid of a desired shape by winding at least one amorphous strip about a central hole;

(ii) annealing each of the planar toroids;

(iii) impregnating each of the annealed planar toroids by a binding material;

(iv) producing three column-like elementary circuits of said magnetic circuit from amorphous strips, wherein each of the column-like elementary circuits is produced as a toroid of a desired height by winding at least one amorphous strip about a central axis;

(v) annealing each of the column-like toroids;

(vi) impregnating each of the annealed column-like toroids by a binding material;

(vii) forming each of the impregnated column-like toroids with a radial slot extending along the height of the column-like toroid and filled with an insulating material;

(viii) mounting a coil block on each of the column-like toroids with the slot to form the corresponding one of the three phases of the transformer;

(ix) attaching opposite butt-end surfaces of each of the column-like toroids to the plate-like elements, respectively and arranging the column-like toroids in a spaced-apart parallel relationship, such as to form the magnetic circuit of the transformer as a spatial symmetrical structure about a central axis of the transformer presenting the closed magnetic circuit for magnetic flux propagation therethrough, spacers between the elements of the magnetic circuit of the transformer being filled with a material containing a magnetic powder.

2. The method according to claim 1, wherein in step (i) the strip is secured to a mandrel having a triangular cross-section and rotatable about its central axis, and, upon obtaining a desired size of the plate-like element by rotating the mandrel, the element is fixed in the obtained state and excess of the strip is cut off.

3. The method according to claim 1, wherein the fixing of the planar toroids and of the column-like toroids also includes welding of the ends of the amorphous strips.

4. The method according to claim 1, wherein in step (i) several amorphous strips are wound having different widths, the total width of the strips being equal to the desired height of the plate-like element.

5. The method according to claim 4, wherein the strips in the adjacent layers of the plate-like element are displaced from each other such that the strips of one layer overlap a gap between the strips of the adjacent layer.

6. The method according to claim 1, wherein in step (iv) each of the column-like toroids is produced by mounting several toroidal elements on top of each other.

7. The method according to claim 1, wherein in step (iv) said amorphous strips have different widths, the total width of the strips being equal to the desired height of the toroid.

8. The method according to claim 7, wherein the strips in the adjacent layers of the toroid are displaced from each other such that the strips of one layer overlap a gap between the strips of the adjacent layer.

9. A three-phase transformer comprising a magnetic circuit and three coil blocks, the transformer being manufactured according to the method of claim 1.

10. The method according to claim 1, wherein the annealing of each of the toroids is carried out in a magnetic field.

11. The method according to claim 1, wherein temperature of the annealing process is up to about 550° C.

12. The method according to claim 1, wherein in step (iii) said annealed planar toroids are impregnated by a first binding material, and in step (vi) said annealed column-like toroids are impregnated by a second binding material.

* * * * *